United States Patent [19]

Falk et al.

[11] 4,195,584

[45] Apr. 1, 1980

[54] TUFTING NEEDLE

[76] Inventors: Curt L. Falk, Rullstensvägen 20, S-360 50 Lessebo; Arne E. Johansson, Turevägen 17, S-360 60 Vissefjärda, both of Sweden

[21] Appl. No.: 884,965

[22] Filed: Mar. 9, 1978

[30] Foreign Application Priority Data

Mar. 9, 1977 [GB] United Kingdom ..... 9936/77

[51] Int. Cl.[2] ..... D05B 85/00

[52] U.S. Cl. ..... 112/222

[58] Field of Search ..... 112/262, 266, 222, 224, 112/79 R

[56] References Cited

U.S. PATENT DOCUMENTS

| | | | |
|---|---|---|---|
| 29,648 | 8/1860 | Drake | 112/222 |
| 1,235,587 | 8/1917 | Moffatt | 112/222 |
| 1,323,340 | 12/1912 | Weis | 112/222 |
| 1,924,378 | 8/1933 | Rattie | 112/224 |
| 2,990,792 | 7/1961 | Nowicki | 112/79 |
| 3,020,863 | 2/1962 | Smith | 112/79 A |
| 3,397,660 | 8/1968 | Luther | 112/222 |
| 3,403,647 | 10/1968 | Supitar | 112/222 |

FOREIGN PATENT DOCUMENTS

| | | | |
|---|---|---|---|
| 2623796 | 6/1977 | Fed. Rep. of Germany | 112/222 |
| 1433041 | 2/1966 | France | 112/222 |

*Primary Examiner*—Ronald Feldbaum
*Attorney, Agent, or Firm*—Stanley B. Kita

[57] ABSTRACT

A tufting needle having a pair of eyes, an upper and a lower spaced apart vertically wherein the needle when penetrating the backing fabric the upper eye does not penetrate the backing fabric in the lowermost position.

5 Claims, 11 Drawing Figures

Figures 1, 2, 3, 4, 5:
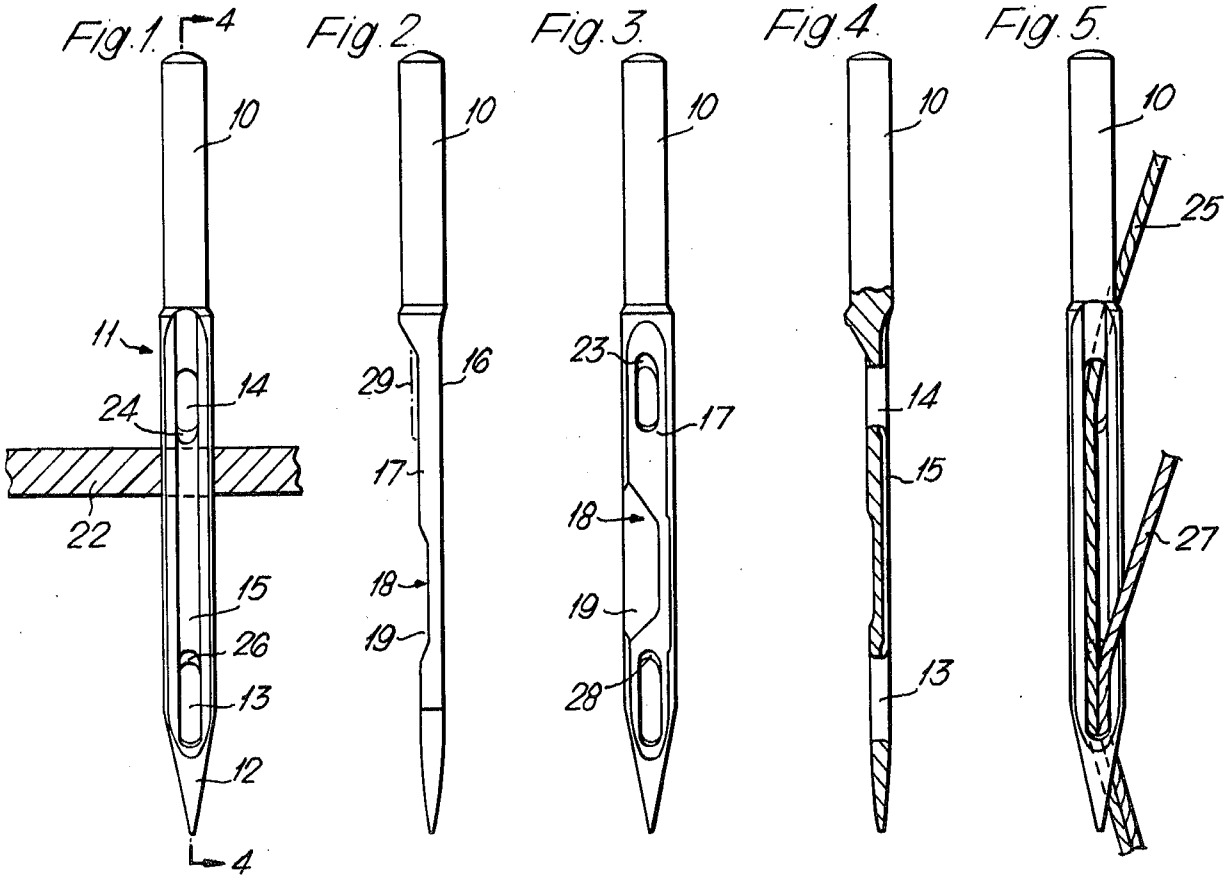

4
10
11
12
13
14
15
16
17
18
19
22
23
24
25
26
27
28
29

10
25
27

10
14
15
26
13
12
11
24

10
23
17
28
18
20 a
b
20
c
d 10
17
18
20
16

27
21
25

TUFTING NEEDLE

This invention relates to methods of making a tufted pile fabric, such as a carpet or rug, and to a needle for use in such methods. Tufted pile fabric made by a method of the present invention can have cut pile or uncut pile depending on the particular treatment of the pile after the loops of pile yarn have been thrown by the looper. Accordingly, the methods of the present invention are not to be held limited to one particular form of such treatment.

For convenience, in this specification the relative parts of a needle will be described and referred to as if the needle is vertical with its point lowermost.

In the manufacture of tufted pile fabrics it is sometimes desired to throw two loops of pile yarn at a single penetration of the backing fabric by the needle. To achieve this it is known to use a needle having two eyes and to thread a respective pile yarn through each eye. In use, both eyes take their respective yarn through the backing fabric and a looper cooperates with the needle by picking up both yarns on a single bill which slides between the needle and the yarns at a position above the upper eye. If it is desired that the two loops have the same size then the yarn threaded through the lower eye must be pulled to take up the difference in the initial sizes of the two loops which is due to the spacing between the eyes. However, a disadvantage in this known method is that one obtains a great frictional force between the yarns and the backing fabric when the yarns went through the backing fabric as both eyes take their respective yarn through the backing fabric. Owing to the fact that the yarns form an angle with the needle one obtains a greater friction between the yarns and the backing fabric.

An alternative known method uses a needle with a single eye and has both pile yarns simply threaded through the one eye. However, a disadvantage in this latter known method is that it is only suitable for use when two pile yarns to be threaded together through the eye are of the same colour. The two yarns run substantially parallel to each other from the yarn feed to the eye and can become twisted with the result that the relative positions of the yarns in the eye are not constant and predictable. Therefore if the yarns were of different colours there would be produced a tufted pile fabric having stripes or streaks instead of a uniform coloured tuft or pile surface with a desired mixture of the two different colours.

It has been suggested that the tension of one of the yarns should be made greater than that of the other yarn, by use of a brake, in order that the tensioned yarn will tend to remain positioned under the other yarn. However, it has been found that breakdowns and interruptions occur when the yarns threaded through the same eye have different tensions. A further disadvantage of this latter method is that when the needle is in its top-dead-centre or uppermost position it pulls the yarns upwardly so that they become forced against the lower end of the eye. Then when the needle passes through the backing fabric the yarns are forced into the yarn guide groove of the needle and against the upper end of the eye. This continual moving up and down of the yarns in the eye also leads to breakdowns and interruptions.

The angle of the yarns to the needle of the backing fabric makes that the backing fabric on the return stroke of the needle is lifted which has to be avoided.

A tufting machine typically has about 1100 needles, and it will thus be appreciated that it is desirable to have a reliable method of tufting to reduce the down-time for the machine.

Accordingly to one aspect of the present invention there is provided in a method of making a tufted pile fabric, the step of simultaneously throwing a loop of each of first and second pile yarns which are threaded through a needle having a pair of vertically spaced eyes with the first yarn threaded only through the lower eye and the second yarn threaded through both eyes. Preferably the reciprocatory movement of the needle is controlled such that the upper eye of the needle does not pass through or enter the backing fabric.

Preferably the pile yarns extend through the lower eye in the same direction. In other words, the yarn runs leave the lower eye at the same side of the needle. Here the term "side" is used in the same sense that an eye extends through the needle from one side to the other side. It will thus be appreciated that this method aspect of this invention is not limited to the use of needles having a blade portion of a generally flattened cross-sectional configuration, although the use of needles having such a blade portion is preferred.

By threading the first pile yarn through the upper eye as well as through the lower eye, any change in the relative orientation of the yarns in the lower eye is resisted, and thus it is possible to use different coloured yarns and obtain a uniform appearance of the tufted pile fabric.

According to another aspect of this invention there is provided a method of making a tufted pile fabric including the step of throwing single or double yarns from a needle having the pile yarn or yarns threaded through a pair of vertically spaced eyes. In a further method there is provided a method wherein the run of pile yarn between the eyes being disposed within a yarn guide groove. Because the feed of pile yarn to the lower eye is via the upper eye there is less frictional force between the yarn and the backing fabric. But also because of the existing yarn guide groove there is less frictional force between the yarn and the backing fabric. This is due to the fact that one obtains a less angle between the yarn and the needle and a better angle to the backing fabric (the feed of yarn to the lower eye via the upper eye) but also due to a smaller contact area between the backing fabric and yarn and a smaller distortion of the backing fabric upon penetration of the needle and yarn as compared with the case where the yarn does not lie in a yarn guide groove.

According to a further aspect of this invention there is provided a needle for use in a method of making a tufted pile fabric which employs the step of simultaneous throwing of a loop of each of first and second pile yarns threaded together through a needle eye, which needle has a lower eye adjacent the point of the needle adapted for having two pile yarns threaded therethrough, and also an upper eye.

Preferably the needle comprises a shank portion, a blade portion and a point portion. There may be a yarn guide groove in one face of the blade portion extending from the lower eye at least to the upper eye.

In needles having a blade portion, one face of the blade portion (the face opposite the yarn guide groove, if present) may have a portion recessed so as to permit entry of a looper behind pile yarns extending over the face of the blade portion, the recessed portion being disposed between the eyes. The recessed portion comprises a smooth surface without any edges or the like. Preferably the recessed portion extends laterally of the blade portion.

If desired, the lower eye may have a "tear-drop" configuration as is known in the art instead of being parallel-sided.

The upper eye may be of the same general configuration as the lower eye.

Figures 6, 7, 8, 9, 10, 11:
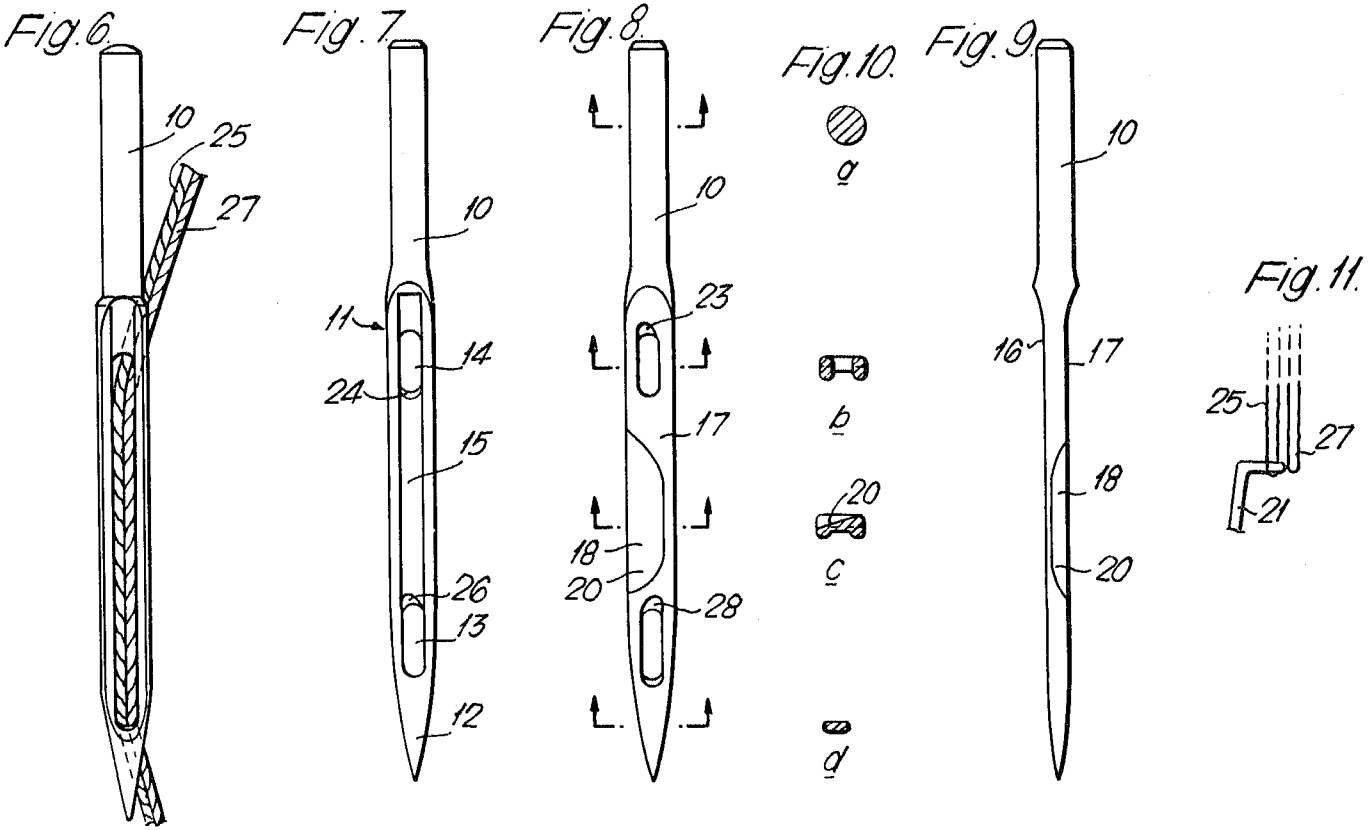

A specific embodiment of a needle according to the present invention and its use will now be described by way of example with reference to the accompanying drawings in which FIG. 1 is a front view of a first needle, FIG. 2 is a side view of the needle shown in FIG. 1, FIG. 3 is a rear view of the needle shown in FIG. 1, FIG. 4 is a section taken along the lines 4—4 in FIG. 1, FIG. 5 is a front view showing a first threading arrangement for two yarns, FIG. 6 is a front view showing a second threading arrangement for two yarns, FIG. 7 is a front view of a second needle, FIG. 8 is a rear view of the needle shown in FIG. 7, FIG. 9 is a side view of the needle shown in FIG. 8, FIGS. 10*a–d* are sections taken along shown lines in FIG. 8 and FIG. 11 shows a view of a partly shown looper.

In the Figures there is shown a needle comprising a shank portion 10, a blade portion 11, a point portion 12, a lower eye 13 and an upper eye 14, whereby the lower eye 13 is disposed at the junction of the blade portion 11 and the point portion 12 and the upper eye 14 is disposed within the blade portion.

A yarn guide groove 15 extends in the front face 16 of the blade portion 11 from the upper end of the lower eye 13 to just above the junction of the shank portion 10 and the blade portion 11.

The blade portion 11 contains in its back face 17 a recess portion 18 for permitting a loop of yarn to be thrown off the needle by use of a looper as is well known in the art of tufting. The recess portion 18 comprises a flat and smooth depressed region 19, which can be parallel to the plane of the blade portion 11, or preferably, as shown in FIGS. 8, 9 and 10*c*, as an inclined plane 20 for improving access for the looper to the underside of yarn extending upwardly over the back face 17 from the lower eye 13. The major part of the length of the depressed region 19 or inclined plane 20 has a width less than the width of the blade portion 11.

As can be seen in FIGS. 3 and 8, the upper end of the upper eye 14 merges with the back face 17 via a short lead-in groove or cutting 23 which is angled to the left in order to conform with a feed of yarn from that side, as shown in FIG. 5. The lower end of the upper eye 14 is similarly provided with an angled cutting 24 for biasing the upper yarn 25 towards the left hand side of the yarn guide groove 15. The upper end of the lower eye 13 meets the yarn guide groove 15 via a cutting 26 which is similarly angled towards the left hand side of the groove 15. The cuttings 24 and 26 thus act to urge the upper yarn 25, when under tension, to the left side of the groove 15 as shown in FIGS. 5 and 6, to leave room for a lower yarn 27 to lie in the right hand side of groove 15 when the needle is pushed through a backing fabric.

The upper end of the lower eye 13 has a cutting 28 merging with the back face 17 in the same manner as cutting 23 so as to bias the upper and lower yarns 25, 27 to the left so as to overlie the depressed region 19 or the inclined plane 20 of the recess portion 18 when the needle is pushed through the backing fabric and thereby facilitate the throwing of loops of yarn off the needle by the looper. As is known in the art, the loops can be left uncut or can be cut.

In the tufting operation, the needle penetrates a backing fabric to the maximum extent indicated in FIG. 1. Thus it will be understood that the upper eye 14 does not act to carry a loop of yarn below the fabric in the manner of the aforementioned known double-eyed tufting needles where each eye has a respective single yarn threaded therethrough and a looper has to move across the respective recess portion disposed above the upper eye to throw a loop of the yarn threaded through the upper eye. In the present case the needle has only one recess portion for use in throwing loops of yarn and this is disposed between the upper and lower eyes. Each throwing action of the looper produces two loops (one of each yarn) of the same height or preferably some different height, as shown in FIG. 11. Thus, the looper 21 release the lower yarn 27 before the upper yarn 25 during the return stroke of the needle, whereby said lower yarn 27 is drawn back a little during said return stroke of the needle. Due to this, the upper yarn 25 will be situated some "higher" or reach higher in the backing fabric. This example can be referred to the embodiment shown in FIG. 6, whereby the dominating of one colour before the other or second colour is not so marked as compared with the case according to FIG. 5, when yarns of different colours are used. The relation of the mixture according to FIG. 6 is about 60 to 40 with regard to the upper yarn 25. According to the embodiment shown in FIG. 5, the colour of the lower yarn 27 is going to dominate in the tufted pile fabric.

Because the upper yarn 25 is threaded through both eyes 13, 14, it lies substantially vertically in the yarn guide groove 15, and consequently in operation, when the needle is in the region of top dead centre of its vertical oscillatory movement, the tensions on the upper yarn 25 will tend to pull it towards the left of the lower eye 13 (as seen in FIG. 5), whereas the tensions on the lower yarn 27 will tend to pull the lower yarn towards the right of the lower eye 13. The cutting 26 enhances this action of the yarn tension on the upper yarn 25, and the cutting 24 acts to keep the upper yarn 25 to the left so as to keep the yarn more nearly vertical and to avoid the upper yarn 25 encroaching on the right side of the yarn guide groove 15 where the lower yarn 27 will lie when the needle extends through the backing fabric. Thus less force is required to be exerted on the lower yarn 27 by the backing fabric for urging it into the yarn guide groove 15.

Without exceeding the scope of the concept of the invention, modifications may be made to the arrangements shown and described. Thus, if desired, the thickness of the blade portion 11 can be increased in the region of the upper eye 14 as shown by chain line 29 in FIG. 2. Because it is intended that in use the upper eye will remain above the backing fabric 22 at all times, there is no need for the thickened portion 29 to merge gradually with the rest of the blade portion in order to reduce penetration forces on the backing fabric and reaction forces on the needle. In the above described needle the width of the eye can be about 50% of the width of the blade portion 11. It is known to have an eye having a width of about 65% of the width of the blade portion, and in comparison with such a prior art needle, the present needle will be stronger at the eyes and in particular at the point portion. Whereas the cutting 23 is inclined to the left as seen in FIGS. 3 and 8 in order to accommodate a feed of yarn as seen in FIG. 5, the cutting can be inclined in the opposite direction if the feed for the upper yarn is provided on the opposite side of the needle to the feed for the lower yarn. Such an arrangement would enhance the tendency of the upper yarn to keep to the left of the yarn guide groove. The width and also the configuration of the eyes can be different from the eyes shown and described. Therefore, the invention is not limited to the embodiments shown and described, but only by the following patent claims.

We claim:

1. In a tufting machine needle having a shank with an elongated blade depending from the shank and terminating in a tip, the improvement wherein said blade has a pair of eyes, an upper one of said eyes being located adjacent said shank and the other lower one of said eyes being located adjacent said tip, both of said eyes extending through said blade from one side thereof to the other, said one side of said blade having an elongated yarn guide groove extending laterally of said eyes from substantially said tip to said shank, said other side of said blade having a looper recess disposed between said eyes, said eyes being spaced apart vertically a substantial distance, so that when the needle is mounted in a tufting machine and backing fabric is presented to the needle, the upper eye adjacent the shank does not penetrate the backing fabric when the needle is in its lowermost position.

2. The tufting needle according to claim 1 wherein said looper recess is located on said blade relative to said upper eye as to have passed through said backing when the needle is in said lowermost position.

3. The tufting needle according to claim 1 wherein said recess has a beveled surface on said blade inclining transversely across the center of the blade to merge with said other side of the blade and extending both transversely and longitudinally adjacent its upper and lower end portions to effect a gradual merger with said other side of the blade.

4. The tufting needle according to claim 1 wherein the lower end of said upper eye and the upper end of said lower eye have cuttings arranged relative to one another and said yarn guide groove in said one side of said blade to dispose a yarn in said groove laterally along one side of the groove when the yarn is threaded through both eyes so as to lay in said yarn guide groove.

5. The tufting needle according to claim 1 wherein said blade is relatively flat and said upper and lower eyes are vertically elongated and have widthwise dimensions corresponding to about half the width of the blade for accommodating a pair of pile yarns side by side in said yarn guide groove when both pile yarns are threaded through both of said eyes.

* * * * *